US005546072A

United States Patent [19]

Creuseremee et al.

[11] Patent Number: 5,546,072

[45] Date of Patent: Aug. 13, 1996

[54] ALERT LOCATOR

[75] Inventors: Melville C. Creuseremee, Danvillle; Jack L. May, Foster City, both of Calif.

[73] Assignee: IRW Inc., Redondo Beach, Calif.

[21] Appl. No.: 279,760

[22] Filed: Jul. 22, 1994

[51] Int. Cl.[6] ..... G08B 13/00

[52] U.S. Cl. ..... 340/574; 340/514; 340/515; 340/539; 342/368; 342/451; 348/143; 455/100

[58] Field of Search ..... 340/574, 573, 340/541, 692, 691, 686, 514, 515, 539, 825.69; 381/56, 41; 455/89, 95, 100, 151.2; 348/143; 342/450, 27, 28, 451; 379/37–38

[56] References Cited

U.S. PATENT DOCUMENTS

| | | | |
|---|---|---|---|
| 3,886,534 | 5/1975 | Rosen et al. | 340/517 |
| 4,494,119 | 6/1985 | Wimbush | 342/457 |
| 4,551,727 | 11/1985 | Cunningham | 342/418 |
| 4,611,198 | 9/1986 | Levinson et al. | 340/539 |
| 4,850,018 | 7/1989 | Vogt | 340/505 X |
| 4,881,148 | 11/1989 | Lambropoulos et al. | 361/172 |
| 4,954,836 | 9/1990 | Sakuma | 342/457 X |
| 4,998,095 | 3/1991 | Shields | 340/574 |
| 5,144,661 | 9/1992 | Shamosh et al. | 348/143 X |
| 5,225,809 | 7/1993 | Bunn | 340/574 |
| 5,365,217 | 11/1994 | Toner | 340/539 |

FOREIGN PATENT DOCUMENTS

| | | | |
|---|---|---|---|
| 2221741 | 10/1974 | France | 342/450 |
| 2578059 | 8/1986 | France | 342/458 |

*Primary Examiner*—Thomas Mullen

*Attorney, Agent, or Firm*—G. Gregory Schivley; R. W. Keller

[57] ABSTRACT

A security system for monitoring an area under surveillance includes a transmitter for generating radio frequencies (RF) signals when actuated using an actuator. A sensing station receives the RF signals from the transmitter. A monitoring station generates video signals of the area under surveillance and provides one end of a duplex audio communications system. A control station, coupled to the sensing station and the monitoring station, actuates the monitoring station in response to the RF signals sensed by the sensing station. The control station includes an opposite end of the duplex audio communications system and a display for displaying the video signals.

41 Claims, 5 Drawing Sheets

ALERT LOCATOR

BACKGROUND OF THE INVENTION

1. Technical Field

This invention relates to security systems, and more particularly to security systems for monitoring a surveillance area and including transmitters, carried by users, sensing stations for receiving RF signals from actuated transmitters and directable monitoring stations for immediately providing video signals of the area where the user actuated the transmitter and audio communication.

2. Background

Criminals know that response times of security personnel and police are relatively slow as compared with the time required to commit a crime and escape, particularly in isolated areas. As a result, isolated areas, such as parking garages and lots, experience higher crime rates, especially late at night.

Conventional video surveillance systems typically employ mounted camera(s) which generate video signals for display on monitor(s) at a central location. Surveillance cameras are typically located in vulnerable areas such as doorways, parking garages and lots, etc. and have been mounted on platforms which pan and tilt in response to manual control or pre-established programs.

Conventional security systems employing direction finding antennas which locate actuated transmitters using signal triangulation are disclosed in U.S. Pat. No. 4,954,836, entitled "Follow-Up System for Moving Bodies" to Sakuma and U.S. Pat. No. 5,225,809, entitled "Personal Security System and Apparatus Therefore" to Bunn. The security system in Sakuma .utilizes both directional and non-directional antenna/receiver systems. At least two non-directional antenna/receiver systems having the two strongest received signals are selected when a transmitter is actuated. The directional antenna/receiver systems associated with the selected non-directional antenna/receiver systems rotate direction-finding antennas until maximum signals are received. The security system then performs signal triangulation to determine the location of the actuated transmitter. A central computer displays the location of the actuated transmitter. The security system performs tracking if the transmitter is actuated continuously.

Conventional security systems with direction finding antennas still fail to respond quickly enough to significantly reduce or prevent crimes in isolated areas. While such direction finding systems locate an actuated transmitter immediately and provide the location on a grid map at a control station, such security systems do not provide immediate assistance to the user actuating the transmitter. Response times are typically too long to stop the crime in the early stages, most importantly before significant harm can occur. If security personnel or police arrive after the suspect leaves the scene of the crime, the suspect has a high probability of escape since such security systems do not help identify the fleeing suspect and valuable time can be lost. Conventional security systems are prone to false alarms since each time a transmitter is actuated, security personnel or police must assume that the alarm is real and respond by sending help to the location of the actuated transmitter.

Therefore, a security system which addresses the above-described problems, among others, is desirable.

SUMMARY OF THE INVENTION

A security system according to the present invention for monitoring an area under surveillance includes a transmitter for generating radio frequency (RF) signals when actuated using an actuator. A sensing station receives the RF signals from the transmitter. A monitoring station generates video signals of the area under surveillance and provides one end of a duplex audio communications system. A control station, coupled to the sensing station and the monitoring station, actuates the monitoring station in response to the RF signals sensed by the sensing station. The control station includes an opposite end of the duplex audio communications system and a display for displaying the video signals.

According to one feature of the invention, the RF signals generated by the transmitter include an alert portion, a continuous wave (CW) portion for a CW period, and an identification portion.

According to another feature of the invention, the sensing station includes a direction finding (DF) antenna system. The DF antenna system of the sensing station generates angle data related to the position of the actuated transmitter relative to the monitoring station.

According to yet another feature of the invention, the DF antenna system includes a plurality of electronically variable attenuators. An attenuator drive circuit drives the electronically variable attenuators. A plurality of antennas are coupled to the variable attenuators. The variable attenuators, the attenuator drive circuit, and the antennas electronically simulate a rotating antenna system. Preferably circularly polarized antennas, such as helical antenna elements are used.

According to still another feature of the invention, the sensing station further includes a receiver coupled to the DF antenna system, for receiving the RF signals. A shaping circuit, coupled to the receiver, clips and clamps the RF signals. A decoding circuit, coupled to the shaping circuit, recognizes the alert and identification portions from the clipped and clamped RF signals.

According to still another feature of the invention, the decoding circuit enables output of the receiver, to an angle processing circuit for generating the angle data, after the CW period begins. Before the CW period ends, output from the receiver to the angle processing circuit is disabled to reduce signal processing errors.

In yet another feature of the invention, the sensing station includes a multipath editing circuit for momentarily disabling output to the angle processing circuit during the CW burst when large azimuth multipath signals dominate the received RF signal.

According to another feature of the invention, a sensing station further includes a combining and transmitting circuit for combining the angle data with the identification data and for transmitting the combined identification data and angle data to the control station.

In yet another feature of the invention, the monitoring station further includes a camera, having a field of view (FOV) adjustable in size and orientation from the control station, for generating video signals. A directional microphone and a spotlight are aligned with the camera FOV. A positioning device, coupled to the control station, positions the camera FOV, the spotlight, and the directional microphone towards the actuated transmitter using the angle data. Loudspeakers can be located in the area under surveillance. On/off control of the loud speakers can be performed at the control station. The monitoring station further includes a spotlight for illuminating the FOV of the camera.

Other objects, features and advantages will be readily apparent from the specification, drawings and claims.

BRIEF DESCRIPTION OF THE DRAWINGS

The various advantages of the present invention will become apparent to those skilled in the art after studying the following specification and by reference to the drawings in which.

DESCRIPTION OF THE PREFERRED EMBODIMENT

While the security system including the present invention is being described in conjunction with a transmitter carried and actuated by a person in an area under surveillance, skilled artisans will appreciate that the present invention has a much broader application. For example, the security system can be actuated by a vehicle alarm system or by other sensors/transmitter combinations.

Figure 1:
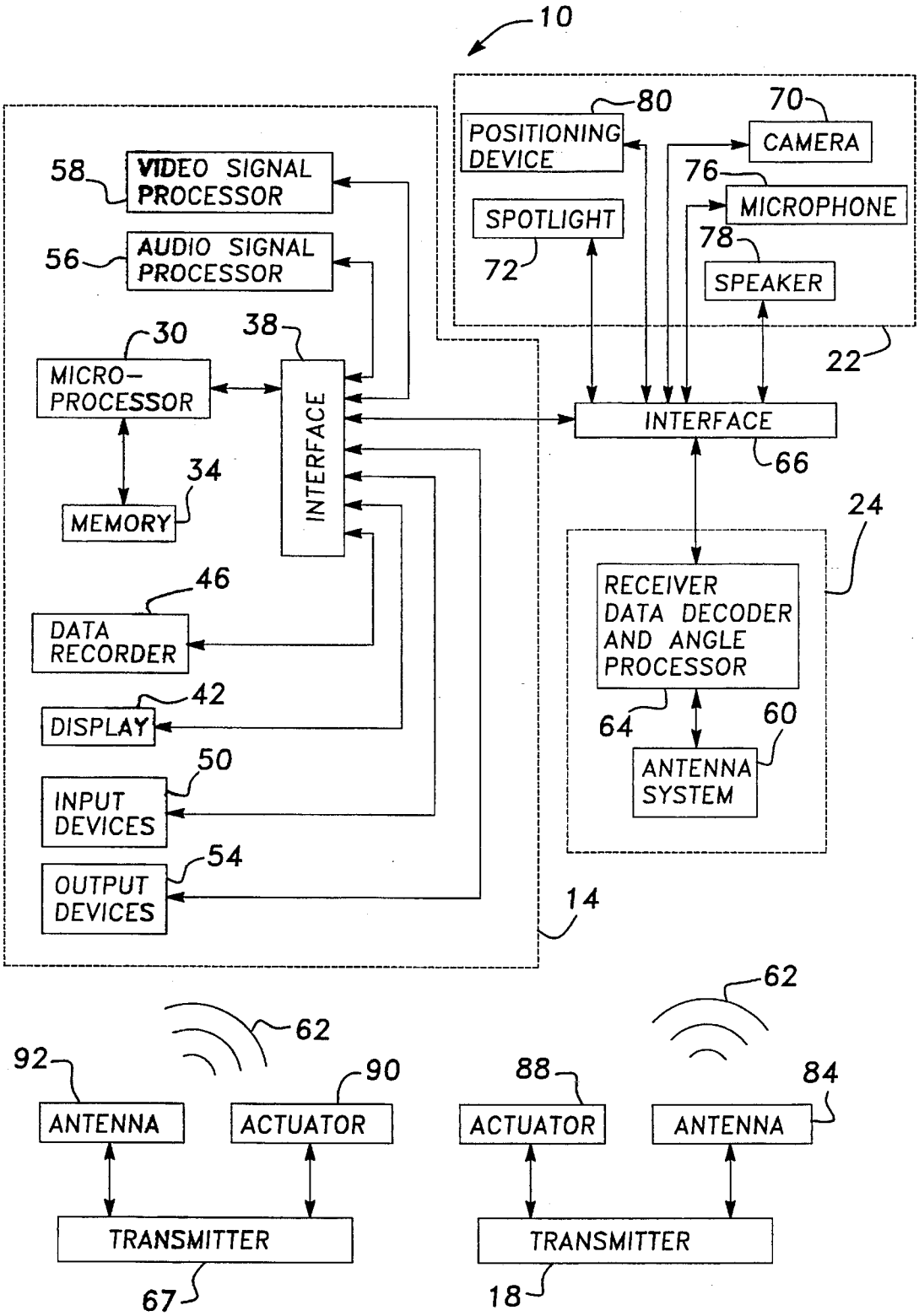
FIG. 1 is a functional block diagram of a personal security system according to the invention.

In FIG. 1, a security system 10 according to the invention is shown and includes a central control station 14, one or more transmitters 18, one or more remote monitoring stations 22, and one or more remote sensing stations 24.

Central control station 14 includes a microprocessor 30 connected to memory 34 which includes internal and external RAM and ROM. Microprocessor 30 and memory 34 are connected via an input/output interface 38 to a display 42, a data recorder 46 (for example a videocassette recorder, a high density digital storage for digitized video, etc.), input devices 50 (such as a mouse 50-3 (FIG. 6), a keyboard 50-1, a microphone 50-2, a joystick 50-4 preferably with zoom and focus switches, etc.), and output devices 54 (such as digital storing devices, printers, speakers 54-1 (FIG. 6), etc.). An audio signal processor 56 and a video signal processor 58 are coupled to interface 38 or directly to microprocessor 30.

Each sensing station 24 includes an antenna system 60 for receiving radio frequency (RF) signals 62 from one or more transmitters 18. A receiver and data decoder 64 processes RF signals 62 and transmits received and decoded data through interface 66 to central control station 14. Security system 10 also includes one or more simulated transmitters 67 which have a fixed or predetermined location in the area under surveillance and which periodically generate RF signals to test security system 10.

Security system 10 includes multiple monitoring stations 22 which are located adjacent to or remote from one or more sensing station(s) 24. Security system 10 includes one or more sensing stations 24 which are connected by interface 66 or by additional interfaces to interface 38. Sensing stations 24 are positioned throughout the area under surveillance. Locating monitoring stations 22 and sensing stations 24 in close proximity allows sharing of power supplies, data link connections, etc.

Central control station 14 transmits sensor control data to a camera 70, a spotlight 72, and a microphone 76, which are mounted on a positioning device 80. A speaker 78 is preferably mounted at a location remote from positioning device 80. Alternatively, speaker 78 can be located on positioning device 80. Speaker 78 is ideally positioned such that audio signals output therefrom can be heard in the area under surveillance. Multiple speakers 78 can be provided. Central control station 14 transmits audio data from the central station's microphone (e.g. input device 50) to the speaker 78. Audio data can also be digitized and compressed. Monitoring station 22 transmits audio data from microphone 76 to central station's speaker (e.g. output device 54). Such audio data can include alarms, voice data from operator, etc. Video signals generated by camera 70 are also transmitted to central station 14. Preferably video signals are compressed by camera 70 or another circuit or processor using compression techniques of the JPEG, MPEG or other types for more efficient transmission and/or storage.

Central control station 14 transmits positioning data to positioning device 80 which preferably provides both pan and tilt mobility to accurately position camera 70, spotlight 72, and microphone 76. Positioning data preferably includes pan, tilt and angle commands. Sensor control data preferably includes camera lens commands (such as zoom, focus and iris), and on/off commands for camera 70, spotlight 72, microphone 76 and speaker 78. Other types of positioning and control data will be readily apparent.

Transmitter 18 includes an omnidirectional antenna 84 and a transmitter actuator 88 which preferably is a button. Alternatively, transmitter actuator 88 can be a voice activated switch, a car alarm sensor output, or outputs of other suitable sensors. Simulated transmitters 67 include an actuator 90 for periodically triggering transmission of the RF signals via antenna 92. Actuator 90 is preferably a timer. Alternately, transmitter 67 is directly wired to central station for manual or automatic actuation by a switch located at central control station 14 or includes a receiver for receiving an actuation signal from a transmitter located at central station 14, monitoring station 22 or sensing station 24. Since the time of actuation and location of simulated transmitter are known, automatic response of personal security system 10 is periodically tested and verified. A test status message, for example an icon with the word "GO" is displayed on display 42 to indicate that personal security system 10 is operating properly. Results of the test are stored in memory 34 for use in system trouble-shooting or for evidence of proper system operation.

Interface 38 of central control station 14 and interface 66 of remote monitoring station 22 is coupled using direct links or through RF or infrared (IR) links (or transceivers). Other links will be apparent to the skilled artisan. Such links are preferably able to carry multimedia including voice, video and data, however separate links may be used for each type of data. Direct links can be copper cable, fiberoptic cable, and carrier current signals using existing powerlines. Fiberoptic cable carries full bandwidth video and is relatively immune to ground loops or interference which can arise if the copper cable is placed in a housing adjacent power lines.

When a user triggers actuator 88, transmitter 18 generates an RF signal, using antenna 84, including an alert code followed by a continuous wave (CW) burst for a CW burst period. Transmitter 18 then generates an identification (ID) code which is unique to each transmitter associated with security system 10. The relative order of generating the alert code, the CW burst and the ID code can be varied. For example, the ID code and the alert code can be combined and sent prior to the CW burst. Other transmission variations will be readily apparent.

In a highly preferred embodiment, the alert code includes a first pulse 7 milliseconds in duration. Subsequently, at 4 millisecond intervals, alternating ones and zeros are transmitted. A zero is a pulse 300 microseconds in duration and a one is a pulse 600 microseconds in duration. After the alert code, the transmitter 18 transmits the CW burst for preferably 30 to 150 milliseconds after which the identification code is transmitted. The transmitter 18 can repeat the alert code, the CW burst, and the identification code one or more times immediately or periodically. Other data may also be transmitted to convey specific requests or commands.

Figure 2:
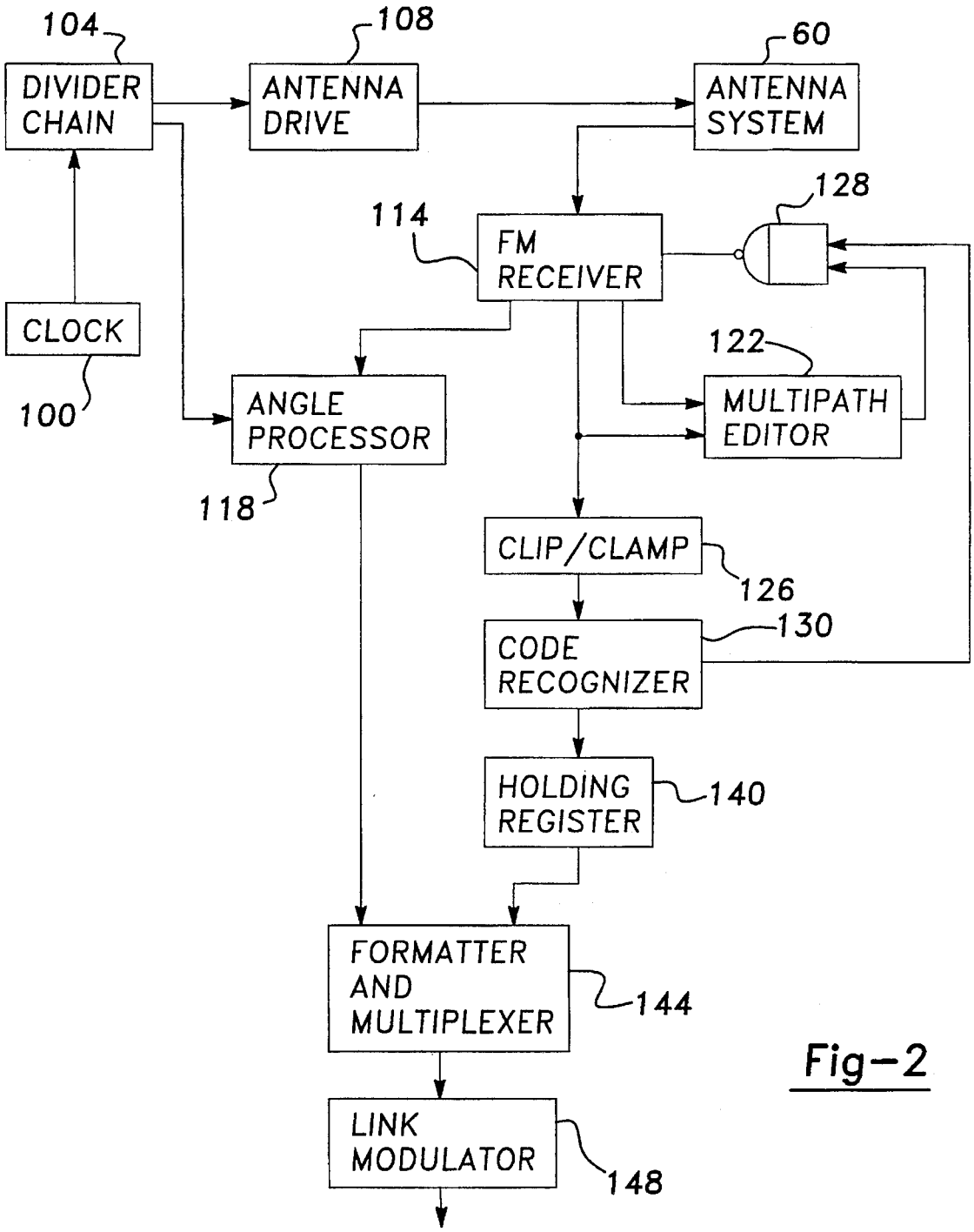
FIG. 2 is a functional block diagram of an antenna system and a receiver and data decoder of FIG. 1 in further detail.

Referring to FIG. 2, antenna system 60 and receiver, data decoder and angle processor 64 are shown in greater detail. A system clock 100 provides timing and is connected to a divider chain 104 which steps down the output frequency of system clock 100 as desired. One output of system clock 100 is connected to an antenna drive circuit 108 which drives antenna system 60.

RF signals received by antenna system 60 are input to a frequency modulated (FM) receiver 114 which demodulates the RF signals. FM receiver 114 outputs a demodulated audio output signal to an angle processor 118 which receives timing signals from a second output of divider chain 104.

Antenna system 60 operates using Doppler direction finding (DF) techniques in -which a rotating receiving antenna is created electronically. Electronic rotation of antenna system 60 frequency modulates a received RF signal from transmitter 18 with a modulation phase dependent on the position of the actuated transmitter 18 relative to the antenna system 60. DF angle processor 118 filters the audio signal output by FM receiver 114, improves the signal to noise (S/N) ratio of the audio output signal, and compares the phase of the audio output signal to the phase of the antenna drive signal. The phase difference is related to the angular position of transmitter 18 generating the RF signal relative to the reference direction of the antenna drive signal of the antenna system 60. Sensing station 24 determines the relative position of the actuated transmitter 18 during a portion of the CW burst period, e.g. after the CW burst begins and before the CW burst ends.

Referring to FIG. 2, FM receiver 114 outputs a signal strength output signal (preferably on a logarithmic scale) to a multipath editor processor 122 and to a clip/clamp circuit 126. FM receiver 114 also outputs an unmuted audio output to multipath editor processor 122. Multipath cancellation of the direct path and the ground reflected path is sensed by multipath editor 122 as signal level degradation increases. Multipath editor 122 inhibits angle output to prevent reflections, with large azimuth errors, from dominating the composite signal. To provide inhibit control during the low level signal, an output of multipath editor processor 122 is connected to one input of a NAND gate 128. An output of NAND gate 128 is connected to an enable gate (with low enable logic) of FM receiver 114. Although multipath editor processor 122 is shown in FIG. 2 as forming part of direction finding unit 24, signal inputs to multipath editor processor 122 may be routed to central control station 14 and multipath editor processor 122 can be associated therewith. If multipath processing is performed at central control station 14, more elaborate algorithms can be employed using input signals from multiple direction finding units 24 receiving the transmitter signal.

A clipped and clamped output signal is input to a code recognizer circuit 130. When code recognizer circuit 130 recognizes the alert code, code recognizer 130 outputs an enable signal to a second input gate of NAND gate 128 which enables FM audio output generated from antenna system 60 to angle processor 118 for a CW sampling period. As a result, angle processor 118 is enabled during the CW sampling period and not during the alert or ID codes to prevent spurious position (i.e. angle data) determinations. Angle processor 118 generates a digital angle value related to the angle of transmitter 18 relative to the position of antenna system 60. After the CW sampling period, code recognizer 130 disables NAND gate 128.

The triggering of NAND gate 128, as described above, enables receiver, data decoder, and angle processor 64 to perform DF functions after receipt of the alert code and after initiation of the CW burst. The NAND gate 128 is disabled before the CW burst period ends (e.g. the CW burst period>the CW sampling period). By gating NAND gate 128 in this manner, false DF readings due to random noise can be reduced and degradation of the DF angle measurement due to turn-on and turn-off FM transients of the transmitter waveform is avoided.

A holding register 140 connected to code recognizer 130 temporarily stores the ID code. A formatting and multiplexing circuit 144, connected to angle processor 118 and holding register 140, combines the ID code and the digital angle value into an alert data word transmitted by a link modulator 148 via interfaces 66 and 38 to microprocessor 30 at central station 14.

Central control station 14 responds to the alert data word, sent by one or more direction finding units 24, by localizing and orienting the transmitter 18 on a map display (described below in conjunction with FIG. 6). Central control station 14 computes direction control signals for transmission to positioning device 80, and enable signals for camera 68, spotlight 72, microphone 76 (if camera 68, spotlight 72 and microphone 76 are not operating in a manual override or automatic actuation already). While only one remote monitoring device 22 is illustrated in FIG. 1 and described herein, one can appreciate that additional monitoring devices can be provided and controlled in a similar manner. The direction control signals instruct positioning device 80 to direct camera 68, microphone 76, and spotlight 72 towards transmitter 18 which generated the detected RF signals.

Figure 3A:
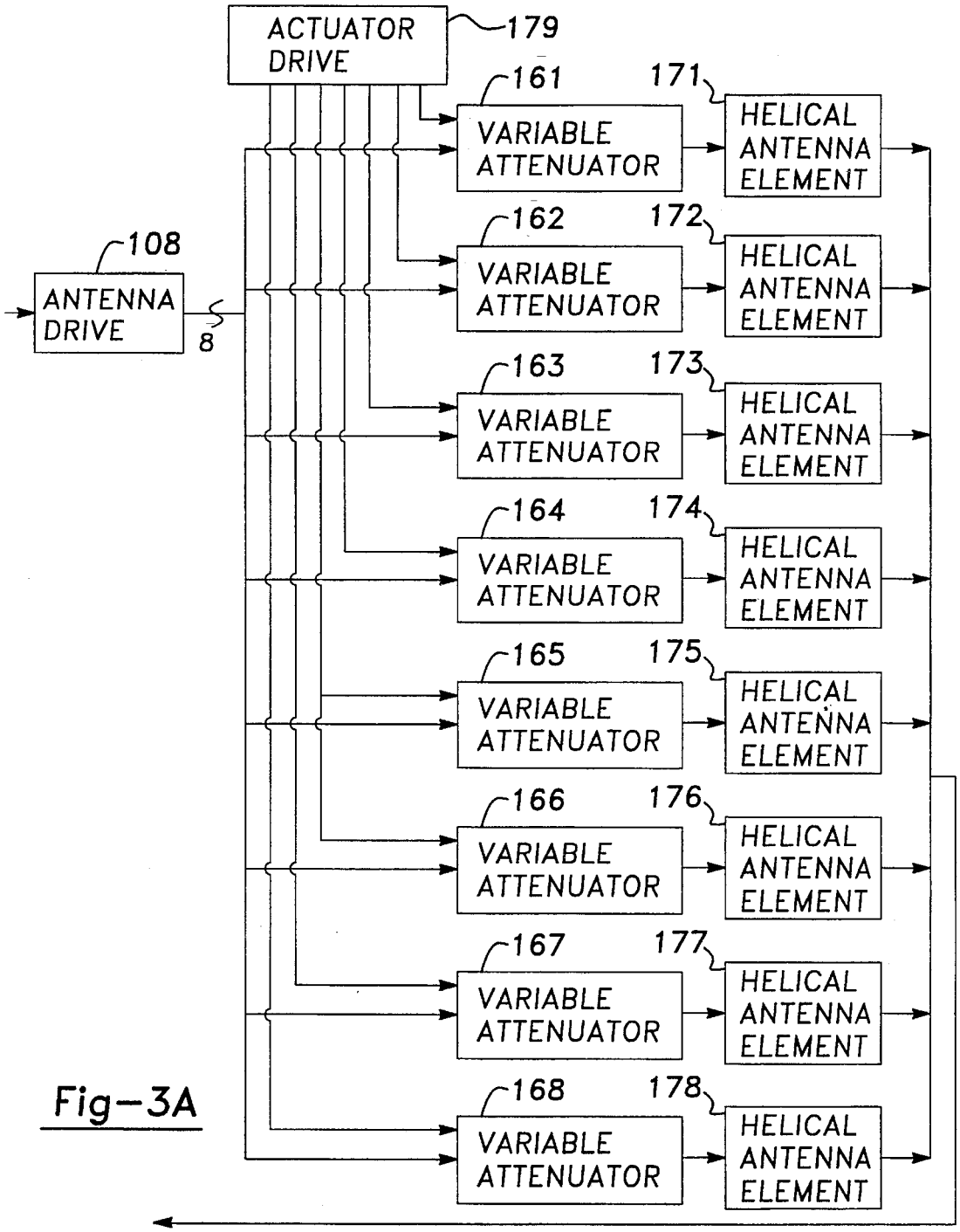
FIG. 3A is a functional block diagram of the antenna system of FIG. 1 in further detail.

Referring to FIG. 3A, a currently preferred antenna system 60 according to the invention includes eight variable attenuators 161–168 connected to eight circularly polarized (CP) helical antenna elements 171–178 respectively. Suitable helical antennas are disclosed in C. C. Kilgas, "Multielement, Fractional Turn Helices," IEEE Transactions on Antennas and Propagation, July 1968, hereby incorporated by reference. In a highly preferred embodiment, the helical antennas are bifilar.

Variable attenuators 161–168 are programmed by attenuator drive circuit 179 as a function of time, each with the same profile but staggered in time relative to a desired sweep angle of the antenna system 60 to simulate a smooth and continuous rotation from one antenna element to the next, and to reduce the harmonics in the antenna modulation.

Outputs of dipole antenna elements 171–178 are combined in a conventional manner and fed to FM receiver 114. Antenna system 60 electronically simulates a physically rotating antenna. A DF antenna system employing variable attenuators is disclosed in Cunningham U.S. Pat. No. 4,551,727, hereby incorporated by reference. Additional or fewer variable attenuator/dipole antenna pairs can be provided. Additional variable attenuator/dipole antenna pairs can decrease multipath effects. Other methods of providing physically or electronically rotating antenna systems are contemplated and will be apparent to skilled artisans.

Figure 3B:
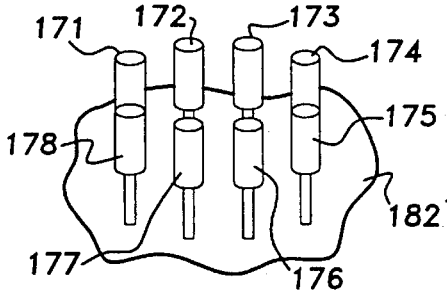
FIG. 3B is a perspective view of helical antenna elements mounted on a stripline circuit board.

Referring to FIG. 3B, helical antenna elements 171–178 are shown mounted in a circle on a stripline circuit board 182. Attenuators 161–168 and baluns are fabricated on stripline circuit board 182. In a highly preferred embodiment in FIG. 3B, helical antenna elements 171–178 are constructed of glass fiber cylinders with a helix-shaped conductor printed on an inside surface thereof. The glass fiber cylinders weatherproof the helical antenna elements. CP helical antenna elements 171–178 preferably have a sin $\alpha$ pattern in elevation where $\alpha=0°$ is parallel to the axis of the helix. The aximuth pattern is preferably constant relative to varying azimuth angles. The polarization observed from any azimuth angle is circular.

Figure 3C:
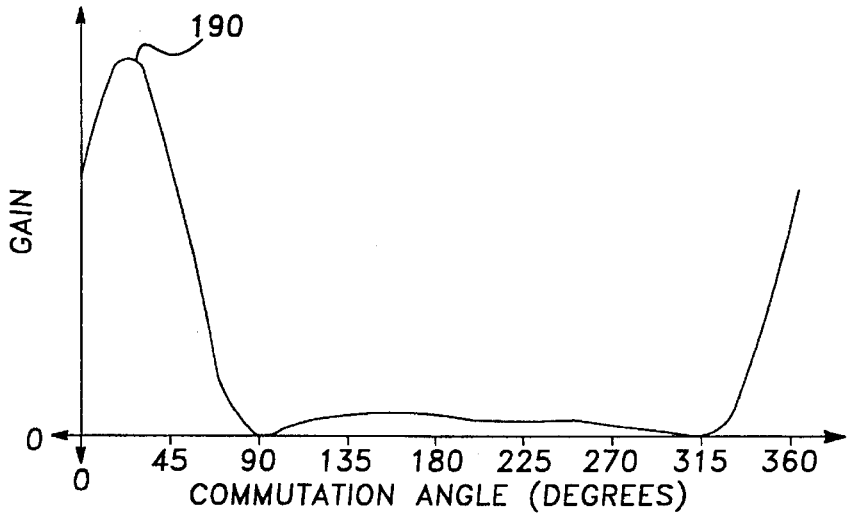
FIG. 3C is a graph of antenna gain versus commutation angle for one helical antenna element-variable attenuator pair.

Referring to FIG. 3C, variable attenuator 171 varies the gain of the corresponding CP helical antenna element 161 as shown. Each of the gains for the other helical antennas 162–168 are similarly varied, however, a peak 190 of the gain response is shifted 45°, 90°, 135°, 180°, 225°, 270° and 315° for other antenna element/variable attenuator pairs. The gain for one antenna decreases to approximately one half of maximum (decreasing) when the gain for the adjacent antenna (45° phase shifted) is one half of maximum (increasing).

Referring to FIG. 4, a test kiosk 200 according to the invention is shown and includes an antenna 203, receiver and decoder 204, an input/output interface 208, a microprocessor 212, memory 214 which can include internal and external RAM and ROM, a display 218, a keyboard or other input device (such as a touch screen, mouse, etc.) 220, and a communications link 222.

Figure 4A:
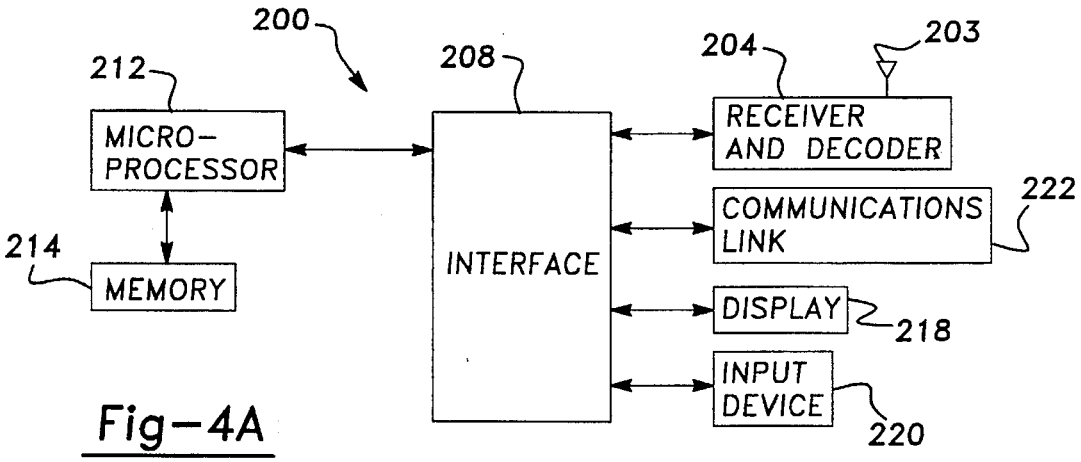
FIG. 4A is an electrical schematic diagram of a test kiosk according to the present invention.
Figure 4B:
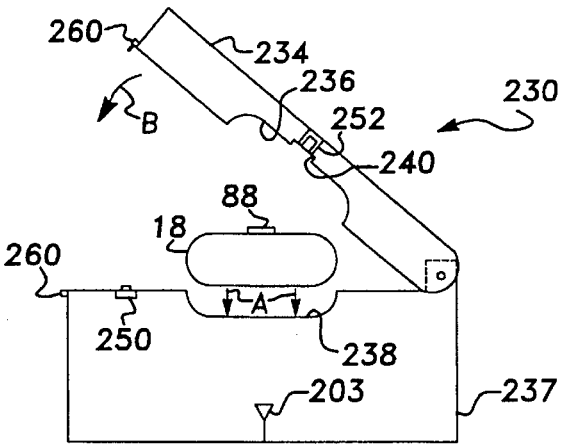
FIG. 4B is an illustration of a coupling fixture utilized in the test kiosk of FIG. 4A.

Referring to FIG. 4B, test kiosk 200 includes a coupling fixture 230 which engages and orients a transmitter 18 to be tested at a standard distance and orientation with respect to antenna 203 which is connected to a receiver and decoder 204. Coupling fixture 230 includes a lid 234 defining a first mating recess 236 and a base 237 defining a second mating recess 238. First and second mating recesses 236 and 238 mate with outer surfaces of transmitter 18 when transmitter 18 is inserted (in the direction indicated by arrows "A") to accurately position transmitter 18. First mating recess 236 may include an actuator recess 240 to receive actuator 88 of transmitter 18 when lid 234 is in the closed position.

Coupling fixture further includes a microswitch 250 and a solenoid 252 which can be connected via interface 208 to microprocessor 212. When microswitch 250 generates a signal indicating that lid 234 is fully closed, microprocessor 212 actuates solenoid 252 (immediately or after a timed period) which depresses button 88 and triggers transmitter 18. RF signals generated by transmitter 18 are received by antenna 203. While additional components of test kiosk 200 shown in FIG. 4A are omitted from FIG. 4B, skilled artisan can appreciate that these components can be located in, nearby, or remote from test kiosk 200. A conventional latch mechanism 260 can be provided to lock lid 234 in the closed position.

Coupling fixture 202 is designed such that transmitter 18 can be inserted in only one way. Coupling fixture 202 will close only if transmitter 18 is positioned correctly. Actuator 88, preferably a button, on transmitter 18 is depressed by coupling fixture 202 automatically to avoid effects of human proximity and to improve consistency and repeatability of the test.

In use, microprocessor 212 executes an operating program, located in memory 214, which instructs a user via display 218 to place a transmitter 18 to be tested in coupling fixture 202. In other words, microprocessor 212 generates step-by-step user instructions on display 218 in a conventional manner. Microprocessor 212 requests a user's name or other identification via display 218 and requests that the user type in responses using input device 220. Microprocessor 212 then provides instructions for inserting transmitter 18 into coupling fixture 202. A user then places the transmitter 18 in coupling fixture 202 which positions transmitter 18 at a predetermined distance from a receiver and decoder 204. Coupling fixture 202 automatically triggers actuator 88 when lid 234 is closed.

Receiver and decoder 204 determines the power output level of transmitter 18 which is related to battery charge level. Coupling fixture 202 ensures that power output level measurements are consistently made by positioning the transmitters 18 to be tested in a standard position with respect to receiver and decoder 204. Receiver and decoder 204 receives and decodes the alert code, the CW burst, and the ID code. Microprocessor 212 verifies the ID code using the user's name or other identification previously entered using input device 220 and verifies the alert code.

Microprocessor 212 stores the ID code, the date, the time, and the transmitter signal output level (which is related to battery strength) in memory 214. Test kiosk 200 includes a communications link 222 providing a data connection to central station 14. Communications link 222 can be a modem, RF link, etc. Memory 34 of central station 14 or memory 214 of test kiosk 200 preferably also includes battery replacement records which can be used to generate battery replacement reminders to users based upon the expected life of the transmitter's batteries.

Figure 5:
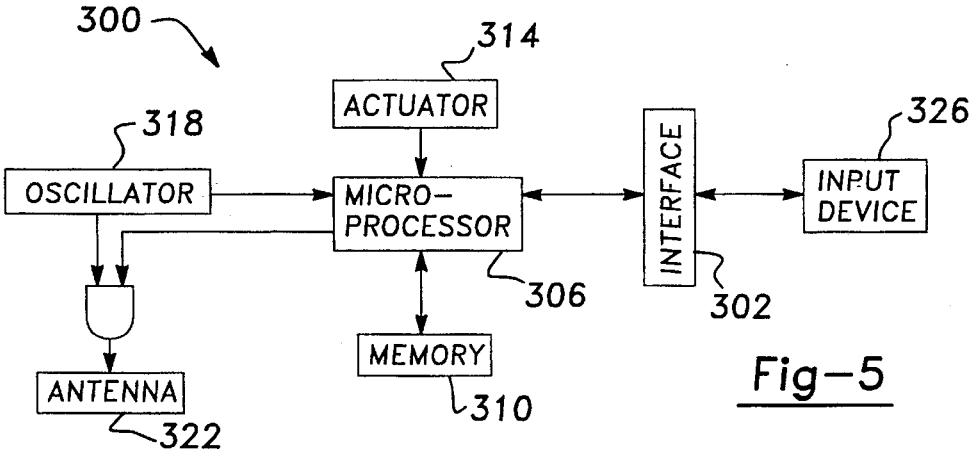
FIG. 5 is a functional block diagram of a transmitter according to the present invention.

Referring to FIG. 5, transmitter 300 is shown in greater detail and includes an input/output interface 302, a microprocessor 306, memory 310, an actuator 314 (for example, a button or a timer), an oscillator 318, and an antenna 322. The alert and ID codes are stored in memory 310. An input device 326 which is connected to interface 302 inputs the alert and ID codes. Operating code for microprocessor 306 is also input via input device 326.

Transmitters similar to transmitters 18, 67 and 300 according to the invention are disclosed in U.S. Pat. No. 4,881,148 which is entitled "Remote Control System for Door Locks", which issued Nov. 14, 1989 to Lambropoulos et al. and which is hereby incorporated by reference. Transmitters disclosed therein output several initialization bits, an ID code, and a function code in contrast to the CW burst, and the alert and ID codes of the present invention. However, modifying such a transmitter to provide such operation will be apparent.

Figure 6:
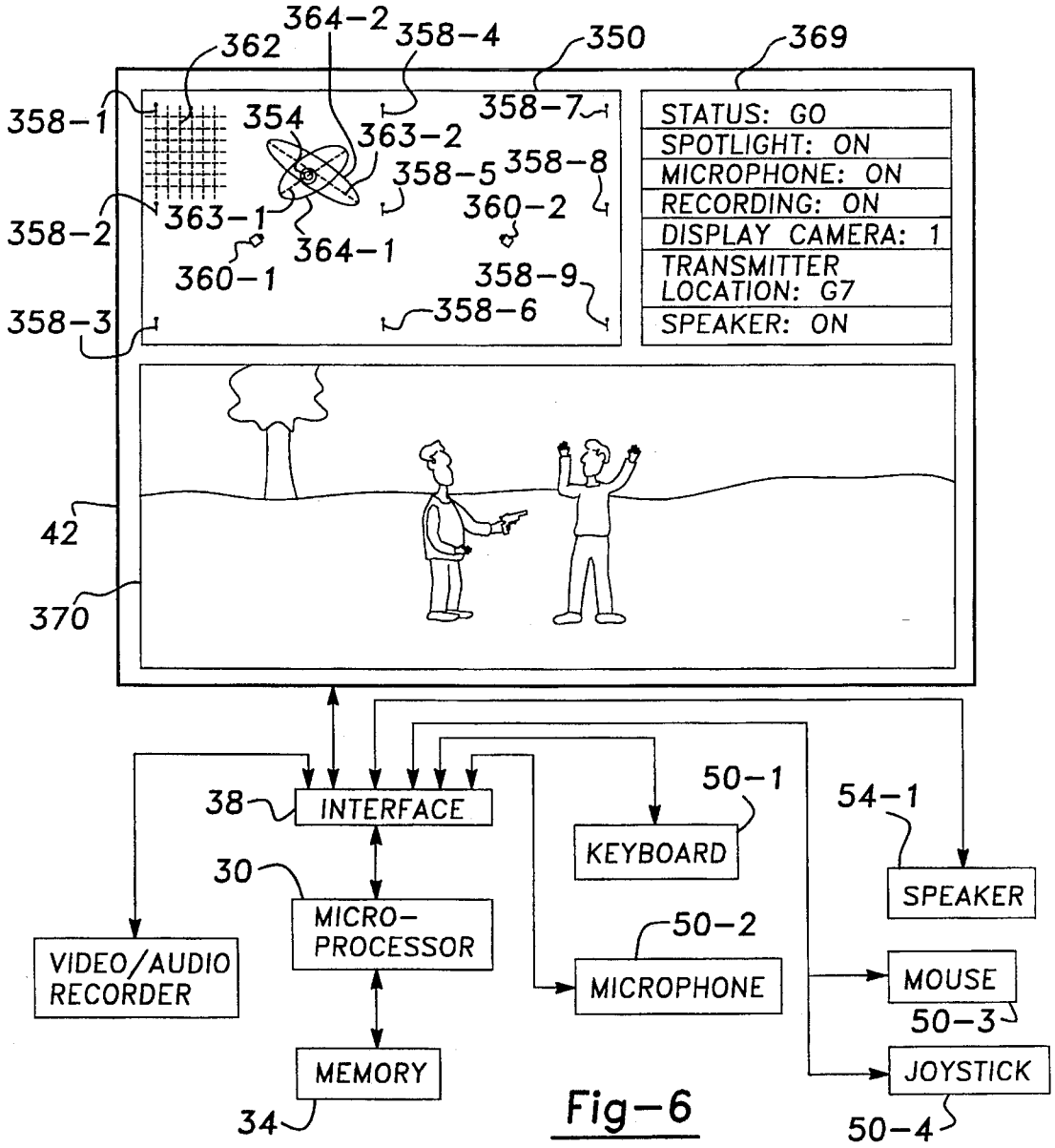
FIG. 6 is an illustration of a display and a functional block diagram of the central control station of FIG. 1.

Referring to FIG. 6, display 42 of central station 14 is shown in greater detail. Display 42 includes a map window 350 which displays the relative position of an actuated transmitter 354 within the area under surveillance. Relative positions of sensing stations 358-1, 358-2, . . . , and 358-9 and monitoring stations 360-1 and 360-2 are preferably also shown. Icons are preferably used to depict transmitter 354, monitoring stations 360, sensing stations 358, etc. in a conventional manner. A grid 362 is preferably defined in map window 350 to allow easier identification of the location of the actuated transmitter 354.

For example, a horizontal side of map window 350 is assigned fixed-size grids A–Z from left to right. A vertical side of map window is assigned fixed sized grids 1-26. Upon actuation, transmitter 354 could be located in grid G7. Preferably, conventional pull-down menus are used to select control options.

A camera centerline 363-1 and an ellipse 364-1 are provided on map view 350 to illustrates the centerline and field of view (FOV) of camera 360-1 so that camera 360-1 is accurately positioned. Similarly, a camera centerline 363-2 and an ellipse 364-2 are provided on map view 350 to illustrates the centerline and field of view (FOV) of camera 360-2 so that camera 360-2 is accurately positioned. Colored shading is preferably used to differentiate FOV 364-1 from 364-2.

Display 42 includes a status screen 369 for displaying on/off status of microphone 76, camera 70, speaker 78, spotlight 72, etc. and the status of the self-test function of security system 10 (described above in conjunction with simulated transmitters 67). Display 42 preferably includes a video window 370 in which video signals from an area surrounding the actuated transmitter 354 are displayed. As can be appreciated, multiple different scenes or views of the same scene can be simultaneously displayed by splitting video window 370. Similarly, map window 350 simultaneously displays different areas under surveillance by splitting window 350 or multiple actuated transmitters in the same area under surveillance are shown.

Video signal processor 58 is used to isolate and select particular frames of interest for further use in identifying a suspect, a vehicle, etc. The selected frames are compared and correlated with criminal files to generate identities of suspects. Dithering, or jumping between multiple frames, and frame averaging are used to improve image analysis. Motion compensation can also be used. The selected frames can be used to identify a license plate of a getaway vehicle. Video signal processor 58 also provides motion sensing functions to track movement, for example to track the suspect and the transmitter user. This involves frame to frame processing where the position of images in successive frames are compared and contrasted with fixed background. Video signal processor 58 can provide motion sensing functions to track movement, for example movement of a suspect and a transmitter user. Video signal processor 58 can track movement by subtracting successive video frames. Video signal processor 58 generates a control signal to move the camera FOV and pixels having significant differences in the camera FOV.

Audio signal processor 56, analyzes, compares, and correlates voice samples collected using microphone 76. The voice samples can be compared and correlated with a voice sample of a suspect as further identification evidence. Suitable audio signal processing techniques are disclosed in L. R. Rabiner, "Applications of Voice Processing to Telecommunications" IEEE Proceedings, Vol. 82, No 2 (Feb. 1994). Audio signal processor 56 can perform audio processing using sonogram (frequency vs. time) comparisons, time and frequency warping, amptitude comparisons, and pattern matching.

The area under surveillance can be a parking garage, an outdoor parking lot, shopping malls or other, preferably open, indoor and outdoor areas. FM receiver 114 can be a SA625 receiver sold by Phillips. Camera 70 can be a high resolution color camera. Camera 70 can be a charge coupled device (CCD) camera which generates analog or digital video signals and can operate at visible or infrared wavelengths. If infrared wavelengths are used, spotlight 72 also preferably operates at infrared wavelengths. Camera 70 can have automatic iris control with manual override capability. Microphone 76 is preferably a directional microphone.

In use, a user carries a transmitter 18 when entering the area under surveillance. Referring to FIG. 1, if the user encounters trouble, the user triggers actuator 88. Transmitter 18 generates an RF signal including the alert code, the CW burst for the CW period, and the identification code which uniquely identifies the user. One or more sensing stations 24 receive the RF signal from the transmitter 18.

Referring to FIG. 2, antenna system 60 and receiver and decoder 64 of each sensing station 24 receiving the RF signal decode the alert code, perform direction finding processing on the CW burst and decode the identification code. Each receiver and decoder 64 transmits the identification code and angle data to central station 14.

Central station 14 analyzes the identification codes and angles from each sensing station 24 and selects at least one monitoring station 22 for surveillance. Central control station 14 uses triangulation (using data from at least two sensing stations 24) to determine the angle and distance to the actuated transmitter in relation to the selected monitoring station 22. Triangulation is described in detail in U.S. Pat. No. 4,954,836, entitled "Follow-Up System for Moving Bodies", which issued to Sakuma and is hereby incorporated by reference.

Central control station 14 transmits control data, position data and audio data to at least one selected monitoring station 22. Positioning device 80 of the selected monitoring station 22 receives the position data from central station 14 and directs the camera 70, spotlight 72 and microphone 76 towards the user. Monitoring station 22 transmits video signals generated by camera 70 and audio signals generated .by microphone 76 to central station 14.

Referring to FIG. 6, central station 14 displays the location of the actuated transmitter relative to map window 350 and video signals in video window 370. An operator turns spotlight 72 on to scare off a suspect and to provide more light for camera 70. The operator talks and listens to the user and the suspect using the microphone 50-2 and the speaker 54-1 associated with central station 14 and one or more monitoring stations 22.

Joystick 50-4 or other devices are used to redirect the camera 70. Alternately, mouse 50-3 is used to select and drag (in a conventional manner) the ellipse 364 to a desired position. Central control station 14 responds to the changes by sending updated position data to the monitoring station(s) 22.

As can be appreciated, the number of monitoring stations 22 and sensing stations 24 required for an area under surveillance will vary according to the size of the area under surveillance, the coverage desired, the resolution and FOVs of the camera chosen, the number of concurrent emergencies to be handled in the area under surveillance, etc. As can be appreciated, video window 370 in display 42 of FIG. 6 can be divided to accommodate multiple video scenes corresponding to concurrent emergencies. Additional displays may also be associated with central control station 14.

As can be appreciated from the foregoing, personal security systems 10 according to the invention allows quick response to an emergency situation. Within moments of actuating a transmitter 18, the personal security system 10 locates the actuated transmitter 18 and provides video, two-way audio and spotlight illumination. Such an immediate response may be sufficient to startle the suspect causing the suspect to flee. The operator can audibly indicate that the suspect is being recorded on video and that police or security personnel are on the way.

Determining the identity of the suspect can be aided through voice samples and multiple video views using one or more cameras. The personal security system 10 also helps identify the color, make and model of the suspect's vehicle or the type and color of the suspect's clothing. The video may provide effective evidence of elements of a crime for trial. Once activated, the transmitter need not be actuated again which can often be difficult in emergency and panic situations.

The self-test features including test kiosk 200 and simulated transmitters 67 ensure proper operation of personal security system 10 and transmitters 18. Automatic periodic operation of transmitters 67 is synchronized with a system test of system elements. System status, determined by the system test, is stored for evidence of proper or improper system operation. Test kiosk 200 records operational performance of a particular transmitter 18 over time.

The various advantages of the present invention will become apparent to those skilled in the art after a study of the foregoing specification and following claims.

What is claimed is:

1. A security system for monitoring a surveillance area comprising:

transmitting means, including a transmitter and an actuator for actuating said transmitter and generating a given radio frequency (RF) signal when actuated;

a plurality of sensing means for receiving said RF signal from said transmitting means;

monitoring means for generating video signals of a field of view (FOV) of said surveillance area;

positioning means for adjusting said FOV of said monitoring means;

control means, coupled to said plurality of sensing means, said monitoring means and said positioning means, for actuating said positioning means and said monitoring means when said RF signal is sensed by said sensing means to position said FOV of said monitoring means to include an area in which said transmitter is located; and display means, coupled to said control means, for displaying said video signals.

2. The security system of claim 1 wherein said control means and said monitoring means include audio means for providing duplex audio communication therebetween.

3. The personal security system of claim 1 wherein said RF signal generated by said transmitting means includes an alert portion, a continuous wave (CW) portion and an identification portion containing identification data associated with the transmitter.

4. The security system of claim 3 wherein said sensing means includes a direction finding (DF) antenna system and wherein said sensing means generates angle data related to the position of the actuated transmitter relative to said monitoring means.

5. The security system of claim 4 wherein said DF antenna system includes:

a plurality of electronically variable attenuators;

attenuator drive means for driving said electronically variable attenuators; and a plurality of antenna elements coupled to said variable attenuators, wherein said variable attenuators, said attenuator drive means and said antenna elements electronically simulate a rotating antenna system.

6. The security system of claim 5 wherein said plurality of antenna elements are dipole antenna elements.

7. The security system of claim 5 wherein said plurality of antenna elements are helical antenna elements.

8. The security system of claim 4 wherein said sensing means further includes:

receiving means, coupled to said DF antenna system, for receiving said RF signal;

shaping means, coupled to said receiving means, for clipping and clamping said RF signal; and decoding means, coupled to said shaping means, for recognizing said alert and identification portions from said clipped and clamped RF signal.

9. The security system of claim 8 wherein said decoding means enables output of said receiving means to an angle processing means for generating said angle data after detection of said CW portion.

10. The security system of claim 9 wherein said decoding means disables output from said receiving means to said angle processing means prior to cessation of the CW portion of the RF signal.

11. The security system of claim 10 wherein said sensing means further includes multipath editing means for momentarily disabling output to said angle processing means during said CW portion when large azimuth multipath signals predominate said received RF signal.

12. The security system of claim 10 wherein said sensing means further includes combining and transmitting means for combining said angle data with said identification data and for transmitting said combined identification data and angle data to said control means.

13. The security system of claim 8 wherein said receiving means is a frequency modulated (FM) receiver.

14. The security system of claim 4 wherein said monitoring means further includes:

a camera, having a field of view (FOV), for generating video signals of said FOV; and a directional microphone, oriented towards said camera FOV, for receiving audio signals.

15. The security system of claim 14 wherein said positioning means positions said camera FOV and said directional microphone towards said transmitting means when said transmitting means is actuated.

16. The security system of claim 14 wherein said monitoring means further includes illumination means for illuminating said camera FOV.

17. The security system of claim 14 wherein said monitoring means further includes a speaker, associated with said control means, for amplifying said audio signals input to said directional microphone.

18. The security system of claim 3 further comprising transmitter testing means for testing operation and battery strength of said transmitter including:

receiver and decoding means for receiving said RF signal from said transmitter, for verifying said alert and identification portions, and said CW portion, and for determining battery strength from signal strength characteristics of said RF signal; and coupling means for orienting said transmitter in a standard position relative to said receiver and decoding means.

19. The security system of claim 18 wherein said transmitter testing means further includes communicating means for communicating said battery strength to said control means.

20. The security system of claim 1 further including a microphone associated with said control means and a speaker in said surveillance area, for amplifying audio signals, input to said microphone.

21. The security system of claim 1 further comprising:

simulated transmitting means, including a simulated transmitter, for generating an RF signal including an alert portion, a continuous wave portion, and simulated transmitter identification portion for testing the status of said security system.

22. The security system of claim 21 wherein said simulated transmitter includes a second actuator means for periodically actuating said simulated transmitting means, wherein said simulated transmitting means is located at a known position in said area under surveillance.

23. The security system of claim 22 wherein said second actuator means is a timer.

24. The security system of claim 1 wherein said display means includes map means for displaying the location of an actuated transmitter relative to the area under surveillance.

25. The security system of claim 1 wherein said actuator is a car alarm.

26. A security system for monitoring a surveillance area comprising:

transmitting means, including an actuating means for activating said transmitting means and generating a given wirelessly transmitted signal when actuated;

monitoring means having a positionable camera for monitoring said surveillance area; and control means for receiving said signal from said transmitting means and positioning said camera to view an area in which said transmitting means is located when said signal is received by said control means.

27. The security system of claim 26 wherein said control means and said monitoring means are remotely located from each other, with said control means and monitoring means each including communication means for bidirectionally wirelessly transmitting video and audio signals therebetween.

28. The security system of claim 26 wherein said control means includes a direction finding (DF) antenna system and wherein said control means generates angle data related to the position of the transmitting means, when actuated, relative to said monitoring means.

29. The security system of claim 28 wherein said signal is a radio frequency (RF) signal and said control means further includes:

receiving means, coupled to said DF antenna system, for receiving said signal;

shaping means, coupled to said receiving means, for clipping and clamping said signal; and decoding means, coupled to said shaping means, for recognizing portions of said clipped and clamped signal.

30. The personal security system of claim 26 further comprising:

simulated transmitting means, including an actuating means for actuating said simulated transmitting means, for generating a wirelessly transmitted signal, simulating said wirelessly transmitted signal from said transmitting means, when actuated.

31. The security system of claim 26 further comprising transmitter testing means for testing operation of said transmitting means including:

receiving and decoding means for receiving said signal from said transmitting means, for verifying portions of said signal, and for determining battery strength from signal strength characteristics of said signal; and coupling means for orienting said transmitting means in a predetermined position relative to said receiving and decoding means.

32. The security system of claim 26 further comprising a display means coupled to said control means for displaying system data.

33. A security system for monitoring a surveillance area comprising:

at least one portable transmitting station, including a transmitter and an actuator for actuating said transmitter and generating a given radio frequency (RF) signal, said RF signal including an alert portion, a continuous wave (CW) portion and an identification portion containing identification data associated with the transmitter, when actuated;

at least one monitoring station including a camera, having a field of view (FOV), for generating video signals of said FOV and a directional microphone oriented towards said camera FOV for receiving audio signals;

at least one positioning mechanism coupled to said monitoring station for adjusting said FOV;

at least one sensing station including a directional finding (DF) antenna system and generating angle data related to the position of said transmitter, when actuated, relative to said monitoring station; and a control station, coupled to said sensing station, said monitoring station and said positioning mechanism, for actuating said positioning mechanism and said monitoring station when said RF signal is received by said sensing station to position said FOV of said monitoring station to include an area in which said transmitter is located.

34. The security system of claim 33 wherein said DF antenna system includes:

a plurality of electronically variable attenuators;

attenuator drive means for driving said electronically variable attenuators; and a plurality of antenna elements coupled to said variable attenuators, wherein said variable attenuators, said attenuator drive means and said antenna elements electronically simulate a rotating antenna system.

35. The security system of claim 33 wherein said sensing station further includes:

a receiver, coupled to said DF antenna system, for receiving said RF signal;

a shaping circuit, coupled to said receiver, for clipping and clamping said RF signal; and a decoding circuit, coupled to said shaping circuit, for recognizing said alert and identification portions of the RF signal and enabling output of said receiver to an angle processing means for generating said angle data after said CW portion begins and for disabling output from said receiver to said angle processing means before said CW portion ends.

36. The security system of claim 35 wherein said receiver is a frequency modulated (FM) receiver.

37. The security system of claim 33 wherein said sensing station further includes combining and transmitting means for combining said angle data with said identification data and for transmitting said combined identification data and angle data to said control station.

38. The security system of claim 33 further comprising:

a microphone in said control station;

speaker means in said monitoring station for broadcasting audio signals input to said microphone in said control station;

illumination means for illuminating said camera FOV of said monitoring station; and second speaker means in said control station for broadcasting said audio signals input to said directional microphone in the monitoring station.

39. The security system of claim 33 further comprising:

at least one simulated transmitting station, including a second actuator for periodically actuating said simulated transmitting station, for generating a second RF signal including an alert portion, a continuous wave portion, and simulated transmitter identification portion, wherein said simulated transmitting station is located at a known position in an area under surveillance and wherein said control station compares said known position to a previously calculated position for said simulated transmitting station.

40. The security system of claim 39 wherein said second actuator is a timer.

41. The security system of claim 33 further comprising at least one transmitter tester for testing operation of said transmitter including:

a receiver and decoder for receiving said RF signal from said transmitter, for verifying said alert and identification portions, and said CW portion, and for determining battery strength from signal strength characteristics of said RF signal;

coupling means for orienting said transmitter in a standard position relative to said receiver and decoding means; and communicating means for communicating said battery strength to said control station.

* * * * *

UNITED STATES PATENT AND TRADEMARK OFFICE

CERTIFICATE OF CORRECTION

PATENT NO. : 5,546,072

DATED : August 13, 1996

INVENTOR(S) : Melville C. Creusere

It is certified that error appears in the above-indentified patent and that said Letters Patent is hereby corrected as shown below:

On the Title page, item [19] & [75] Inventors: "Creuseremee" should be changed to read --Creusere--; and Item [73] Assignee: please change "IRW Inc." to read --TRW Inc.--.

Signed and Sealed this

Twenty-first Day of January, 1997

*Attest:*

*Attesting Officer*

BRUCE LEHMAN

*Commissioner of Patents and Trademarks*